US005511580A

United States Patent [19]

Resseguier

[11] Patent Number: 5,511,580

[45] Date of Patent: Apr. 30, 1996

[54] DEVICE FOR RENDERING A STORAGE CONTAINER INERT

[75] Inventor: Sylvio Resseguier, Rieux, France

[73] Assignee: Elf Atochem S.A., France

[21] Appl. No.: 256,062

[22] PCT Filed: Mar. 15, 1994

[86] PCT No.: PCT/FR94/00279

§ 371 Date: Apr. 7, 1995

§ 102(e) Date: Apr. 7, 1995

[87] PCT Pub. No.: WO94/22744

PCT Pub. Date: Oct. 13, 1994

[30] Foreign Application Priority Data

Mar. 30, 1993 [FR] France ..... 93 03658

[51] Int. Cl.[6] ..... B65D 90/44; B64D 37/32

[52] U.S. Cl. ..... 137/488; 137/209

[58] Field of Search ..... 137/209, 488, 137/492

[56] References Cited

U.S. PATENT DOCUMENTS

| | | | |
|---|---|---|---|
| 1,982,045 | 11/1934 | Clithero et al. | 137/209 |
| 3,227,171 | 1/1966 | Woelfel | 137/488 X |
| 3,788,341 | 1/1974 | Athy et al. | 137/488 X |
| 3,820,562 | 6/1974 | Roberts | 137/209 |
| 5,048,559 | 9/1991 | Mathieu et al. | 137/488 |

*Primary Examiner*—Stephen M. Hepperle
*Attorney, Agent, or Firm*—Pennie & Edmonds

[57] ABSTRACT

The device for the inert rendering of a storage container 21, using a cylinder of pressurized inert gas, which has a pressurizing pipe 3 and an inert-rendering pipe 6 which are intended to be connected to the storage container, and an inert-gas intake pipe 4 intended to be connected to the cylinder of inert gas.

It comprises a pilot valve 1 and a supply valve 2 controlled by the pilot valve. The control inlet of the said pilot valve 1 is connected to the pressurizing pipe 3; the inlet and the outlet of the supply valve 2 are respectively connected to the inert-gas intake pipe 4 and to the inert-rendering pipe 6.

4 Claims, 1 Drawing Sheet

DEVICE FOR RENDERING A STORAGE CONTAINER INERT

FIELD OF THE INVENTION

The subject of the present invention is a device for the inert rendering of a storage container, using a cylinder of pressurized inert gas, which has a pressurizing pipe and an inert-rendering pipe which are intended to be connected to the storage container, and an inert-gas intake pipe intended to be connected to the cylinder of inert gas. The invention relates more particularly to a device for low-pressure inert-rendering.

BACKGROUND OF THE INVENTION

The inert rendering of a storage container consists of replacing the air existing in the storage container with an inert gas. The inert-rendering is, in particular, employed for the storage of inflammable products, for the storage of products which degrade in contact with the oxygen in the air, or even for reactions under an inert atmosphere. In order to render a storage container inert, it is possible to employ various methods, for example a method of pressurization/depressurization or of scavenging by the chosen inert gas. These methods enable the concentration of oxygen in the storage container to be gradually lowered.

The pressure of the inert gas in the storage container is called "inert-rendering pressure". Generally, this pressure is slightly greater than ambient pressure, so that leaks between the storage container and ambient atmosphere do not lead to a decrease in the quality of the inert-rendering.

The problem which the invention is provided to solve is that of maintaining the inert-rendering pressure. In fact, during the use of the storage container and once inert-rendering has been achieved (for example by pressurization/depressurization), manifold factors tend to cause the inert-rendering pressure to decrease. Leading off the product held in the storage container decreases the inert-rendering pressure. Temperature variations of the walls of the storage container may have the same effect. It is therefore necessary to maintain the inert-rendering pressure at its rated value.

SUMMARY OF THE INVENTION

Systems exist enabling this function to be fulfilled. These systems are generally dedicated systems which are fairly complicated, difficult to move and expensive to service. They generally have a device for adjusting the pressure in the enclosure to be rendered inert, which involves a bypass of the adjustment point, which is difficult to control. These systems are not always effective for very low pressures, and often display a random behaviour in ranges of pressure below 10 mb. They do not enable the maximum inert-rendering flow rate to be adjusted and they require a significant supply pressure.

The present invention enables the drawbacks of these systems to be overcome. In the inert-rendering device according to the invention, the pressure in the enclosure to be rendered inert is fixed by construction, which avoids any bypassing. The device remains effective for very low pressures, with high accuracy. It has a maximum inert-rendering flow rate which is variable and easily adjustable. Finally, it operates even with very low supply pressures. The invention provides a reliable system, which ensures rapid inert-rendering and which is capable of being easily adjusted in order to be fitted to various storage containers or adapted to various pressures. The inert-rendering device according to the invention consists of elements which are simple and available on the market, which allows rapid servicing and limits its cost.

The subject of the present invention is a device for the inert-rendering of a storage container, using a cylinder of pressurized inert gas, which has a pressurizing pipe and an inert-rendering pipe which are intended to be connected to the storage container, and an inert-gas intake pipe intended to be connected to the cylinder of inert gas. According to the invention, the device comprises a pilot valve, having one control inlet, one outlet and two inlets which are capable of communicating alternately with said outlet, depending on the pressure at the said control inlet, and a supply valve having one control inlet, one inlet and one outlet which are capable of being connected or not connected, depending on the pressure at the said control inlet; the control inlet of the said pilot valve is connected to the pressurizing pipe; the inlets of the said pilot valve are respectively connected to the pipe and to a reference pressure; the outlet of the said pilot valve is connected via a pipe to the control inlet of the said supply valve; the outlet of the said supply valve is connected to the inert-rendering pipe; and the inlet of the said supply valve is connected to the inert-gas intake pipe.

According to one embodiment of the present invention, the pilot valve and the supply valve are constituted by sliding-spool valves.

Advantageously, the device has, upstream of the supply valve, a valve for adjusting the inert-rendering flow rate.

Furthermore, the device includes a low-pressure supply pipe connecting the inert-gas intake pipe to the pilot valve via a filter and via a pressure-reducing valve.

BRIEF DESCRIPTION OF THE DRAWINGS

Other advantages of the present invention will appear on reading the following description, given by way of example and with reference to the figures, which show.

DETAILED DESCRIPTION OF THE INVENTION

Figure 1:
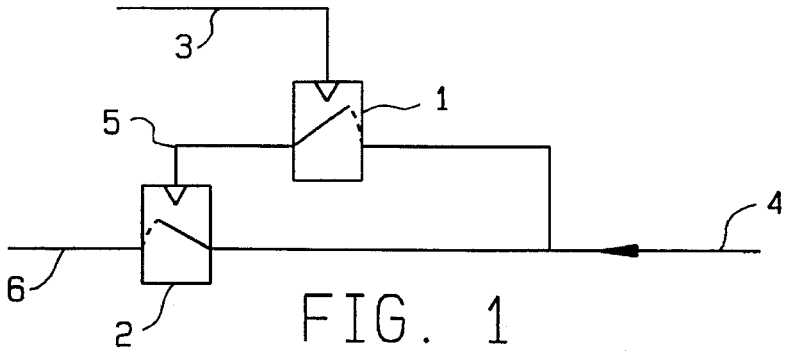
FIG. 1, a flow diagram of the device according to the invention.

FIG. 1 shows a flow diagram of an inert-rendering device according to the present invention. The device comprises a pilot valve 1 and a rapid-action supply valve 2. The pilot valve 1 has one control inlet, one outlet and two inlets which are capable of communicating alternately with the said outlet, depending on the pressure at the control inlet. The supply valve 2 has one control inlet, one inlet and one outlet which are capable of being connected or not connected, depending on the pressure at the said control inlet. The device has a pressurizing pipe 3 on the storage container, which pressurizing pipe is connected to the control inlet of the pilot valve 1. The inlet of the pilot valve is connected to the inert-gas intake pipe 4, which is itself connected to a cylinder of pressurized inert gas. The outlet of the pilot valve is connected via a pipe 5 to the control inlet of the supply valve 2. Advantageously, the pilot valve 1 is a valve in which the outlet is connected either to the inlet of the pipe 4 (valve open), or to a reference pressure (valve open). This reference pressure may simply be atmospheric pressure. The position of the pilot valve 1 depends on the pressure at the control inlet. The inlet of the supply valve is connected to the inert-gas intake pipe 4. The outlet of the supply valve 2 is connected to the storage container via an inert-rendering pipe 6. If a sliding-spool valve is chosen for the supply valve 2, the inlet connected to the intake pipe 4 is either in communication with the pipe 6 going towards the storage container (valve open), or in communication with a plugged outlet (valve closed). The position of the supply valve depends on the pressure at its control inlet and therefore on the pressure in the pipe 5.

The operation of the device of FIG. 1 is as follows. When the inert-rendering pressure in the storage container falls below a first set-point value, the pressure in the pipe 3 which connects the storage container to the control inlet of the pilot valve 1 consequently decreases, and the pilot valve passes into the open position, that is to say the inlet connected to the inert-gas intake pipe 4 is in communication with the outlet of the pilot valve. The pressure in the pipe 5 is then equal to the inert-gas supply pressure in the pipe 4. As a result, the supply valve 2 passes into the open position, that is to say its inlet connected to the intake pipe 4 is in communication with its outlet connected to the storage container via the inert-rendering pipe 6. The inert gas coming from the intake pipe 4 then flows into the storage container via the inert-rendering pipe 6.

The pressure in the storage container then rises. When the pressure in the pressurizing pipe 3 exceeds a second set-point value, greater than the first set-point value, the pilot valve 1 passes into the closed position, and consequently the pipe 5 is no longer in communication with the inert-gas intake pipe but with the atmosphere. As a result, the pressure at the control inlet of the supply valve 2 decreases and the supply valve 2 passes into the closed position, thus cutting off the flow of inert gas to the storage container.

The device of FIG. 1 thus enables the inert-rendering pressure in the storage container to be maintained.

Figure 2:
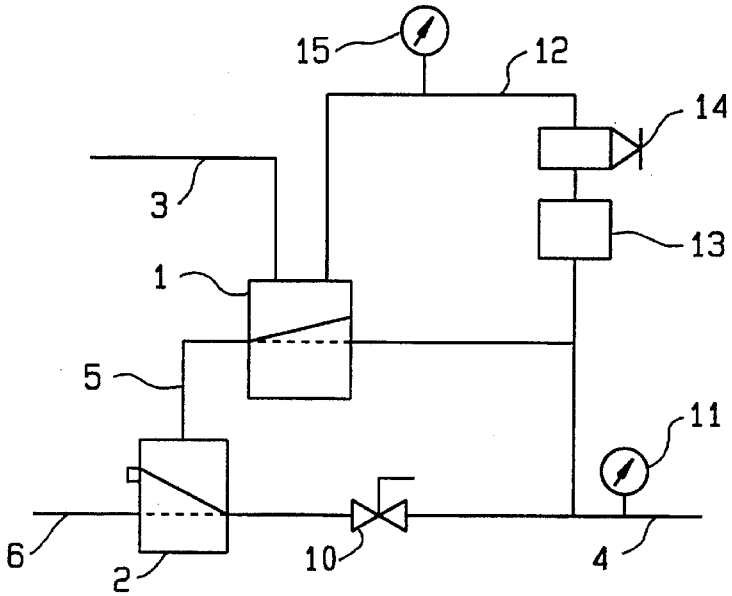
FIG. 2, a more detailed diagram of one embodiment of the device according to the invention.

FIG. 2 shows a more detailed diagram of an embodiment of the inert-rendering device according to the invention. The elements already described with reference to FIG. 1 bear the same numbers. The device of FIG. 2 comprises, on the inert-gas intake pipe 4, immediately upstream of the inlet of the supply valve 2, a valve 10 for adjusting the flow rate, which enables the maximum flow rate of the inert-rendering flow to the storage container to be adjusted manually. Advantageously, the intake pipe 4 has, at the connection to the inert-gas storage means, a high-pressure pressure gauge 11 enabling the pressure in the pipe 4 to be monitored. In parallel with the inlets of the pilot valve 1 and the supply valve 2, a low-pressure supply pipe 12 of the pilot valve is connected up to the pipe 4. This pipe 12 has a filter 13, a pressure-reducing valve 14 and a low-pressure pressure gauge 15 and is connected thereafter to an inlet of the pilot valve 1. In the embodiment of FIG. 2, the pilot valve is a valve comprising a pneumatic piloting device with an amplifier, which requires supply with low-pressure compressed gas. This supply is supplied via the low-pressure supply pipe 12. The low-pressure pressure gauge 15 enables the pressure at the supply inlet of the pneumatic pilot valve 1 to be monitored. The supply of the pilot valve via the low-pressure supply pipe 12 furthermore allows permanent purging with a low flow rate in the pressurizing pipe 3. In this way, any plugging of the pipe 3 is avoided.

In the embodiment of FIG. 2, use may advantageously be made, as the pilot valve 1, of a pneumatic piloting device with an amplifier, coupled to an adaptation module, such as for example, those marketed by the company FESTO. The choice of such a type of valve ensures, on the one hand, operation under a minimum inert-gas supply pressure of the order of 2 b; on the other hand, it enables a precision of the order of 0.5 mb to be obtained and ensures correct inert-rendering, even in the 0.5 to 1 mb pressure range.

The rapid-action supply valve 2 is chosen depending on the inert-rendering flow rate desired, it being understood that the maximum value of the inert-rendering flow rate can be adjusted by action on the manual valve 9 for adjusting the flow rate. The rapid-action supply valve 2 is, for example, constituted by a valve marketed by the company Jouvel et Cordier or alternatively by a valve of the Minimatic type from the company Klein. The choice of the supply valve 2 enables the maximum inert-rendering flow rate to be fixed, depending on the valve employed. This flow rate may thus reach 1700 $Nm^3/h$, for a 1¼" nominal diameter valve, under a supply pressure of 7 b.

Figure 3:
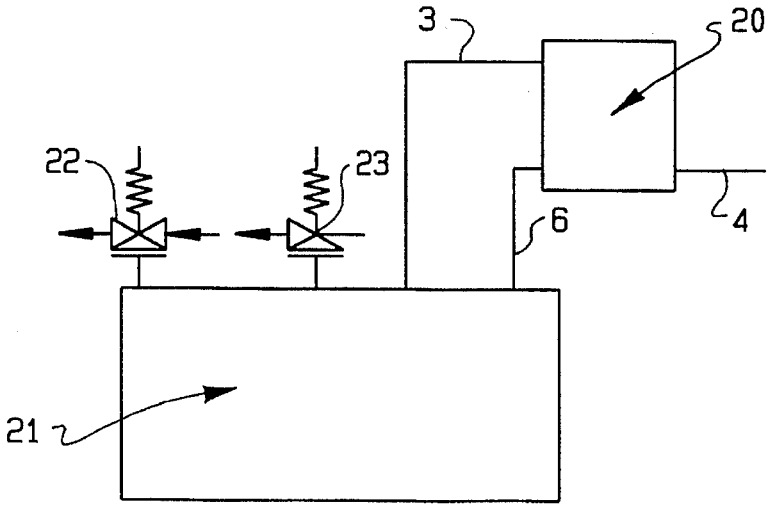
FIG. 3, a diagram of a device according to the invention and of the storage container on which it is mounted.

FIG. 3 shows a diagram of a device according to the invention and of a storage container on which it is mounted. The device 20 according to the invention is connected to the storage container 21 via the pressurizing pipe 3 and the inert-gas intake pipe 6. Advantageously, the pipes 3 and 6 emerge into the upper part of the storage container and are separated by more than one meter so as to ensure uniform pressurization of the storage container. The device 20 is also connected to a cylinder of pressurized inert gas, via the inert-gas intake pipe 4. The storage container 21 has, moreover, a double-acting valve 22, ensuring its mechanical protection, and a release valve 23, allowing release of over-pressurized gas. The valve 23 is adjusted so as to open only when the pressure in the storage container 21 is above the inert-rendering pressure provided by the device 20 according to the invention, and, more precisely, the valve 23 opens only for a pressure above the second set-point value mentioned hereinabove. The double-acting valve 22 is adjusted in a similar way.

Of course, the present invention is not limited to the embodiments described and shown, but it is capable of numerous variants within the grasp of the person skilled in the art without departing from the scope of the invention.

I claim:

1. Device for the inert-rendering of a storage container (21), using a cylinder of pressurized inert gas, the said device having a pressurizing pipe (3) and an inert-rendering pipe (6) which are intended to be connected to the storage container, and an inert-gas intake pipe (4) intended to be connected to the cylinder of inert gas, characterized in that it comprises a pilot valve (1), having one control inlet, one outlet and two inlets which are capable of communicating alternately with the said outlet, depending on the pressure at the said control inlet, a supply valve (2) having one control inlet, one inlet and one outlet which are capable of being connected or not connected, depending on the pressure at the said control inlet, and a low-pressure support pipe (12) connecting the inert-gas intake pipe (4) to the pilot valve (1) via a filter (13) and via a pressure-reducing valve (14), the control inlet of the said pilot valve (1) being connected to the pressurizing pipe (3), the inlets of the said pilot valve (1) being respectively connected to the pipe (4) and to a reference pressure, the outlet of the said pilot valve (1) being connected via a pipe (5) to the control inlet of the said supply valve (2), the outlet of the said supply valve (2) being connected to the inert-rendering pipe (6), and the inlet of the said supply valve being connected to the inert-gas intake pipe (4).

2. Device according to claim 1, characterized in that the pilot valve (1) and the supply valve (2) are constituted by sliding-spool valves.

3. Device according to claim 1, characterized in that it has, upstream of the supply valve (2), a valve for adjusting the inert-rendering flow rate.

4. Device according to claim 2, characterized in that it has, upstream or the supply valve (2), a valve for adjusting the inert-rendering flow rate.

* * * * *